United States Patent [19]

Noel

[11] 4,201,252

[45] May 6, 1980

[54] NON-CLOGGING GRAVITY TRANSFER CONNECTOR FOR CLOSED CONTAINERS

[76] Inventor: Eugene M. Noel, 1215 S. Portofino Dr., Sarasota, Fla. 33581

[21] Appl. No.: 932,445

[22] Filed: Aug. 10, 1978

Related U.S. Application Data

[63] Continuation-in-part of Ser. No. 824,333, Aug. 15, 1977, abandoned.

[51] Int. Cl.[2] ..... B65B 3/06

[52] U.S. Cl. ..... 141/286; 141/364

[58] Field of Search ..... 141/285, 290, 297, 298, 141/300, 309, 310, 311, 363, 364, 365, 367, 369, 375, 391, 319, 366, 286, 383; 211/74; 248/346; 285/370, 383, 397

[56] References Cited

U.S. PATENT DOCUMENTS

| | | | |
|---|---|---|---|
| 139,932 | 6/1973 | Sweetland | 285/397 X |
| 2,666,557 | 1/1954 | Hester | 141/309 X |
| 3,938,563 | 2/1976 | Gall | 141/298 |
| 3,963,063 | 6/1976 | Pascarella | 141/364 X |

FOREIGN PATENT DOCUMENTS

| | | | |
|---|---|---|---|
| 561976 | 10/1923 | France | 141/298 |
| 743 | of 1866 | United Kingdom | 141/298 |

*Primary Examiner*—Frederick R. Schmidt
*Attorney, Agent, or Firm*—Rummler & Snow

[57] ABSTRACT

A device for the gravity transfer of viscous flowable materials between a pair of partly filled closed containers disposed one above the other comprising a generally cylindrical connector body having opposed tapered ends for stopper-like insertion into the pour openings of said containers and having a non-clogging air vent tube therein which is of a length to extend upwardly into fluid communication with the air pocket above the level of the contents of the partly filled upper container, the lower end of the vent tube terminating in a widened and sharp-edged air entrance opening.

3 Claims, 6 Drawing Figures

NON-CLOGGING GRAVITY TRANSFER CONNECTOR FOR CLOSED CONTAINERS

BACKGROUND OF THE INVENTION

This application is a continuation-in-part of my co-pending application Ser. No. 824,333 filed Aug. 15, 1977 now abandoned.

Most all restaurants and other eating places have a problem with one-half to three-quarters empty ketchup or salad dressing bottles, and it is a common practice to upend one half-empty bottle on top of another and to leave them precariously standing overnight for the contents of the upper bottle to hopefully run down into the lower bottle. Various forms of transfer devices have been devised for connecting the bottles in superposed airtight relation for transfer of the contents of the upper bottle to the other and to hold them steady. However, a serious problem concerns the air vent tube which, particularly with viscous materials, becomes clogged at its upper end when the upper bottle is inverted and at its bottom end by the stream of the material flowing through the connecting means and around the vent tube during the transfer process. It is an object of the present invention to correct this problem.

SUMMARY OF THE INVENTION

The gist of this invention lies in a gravity transfer connector for closed containers having a vent tube wherein the top end of the tube, which extends upwardly into the upper container, is enclosed within a cap in the form of an inverted-cup which opens in a downward direction, and the bottom end of the tube, which extends downwardly into the bottom or lower container, is flared outwardly and counterbored to provide a wide, sharp-edged end opening having a divergent side wall which prevents material passing through the connector from above from collecting at the end opening edge and bridging the opening so as to block the flow of air from the lower container to the upper one.

DESCRIPTION OF THE PREFERRED EMBODIMENT

Figure 1:
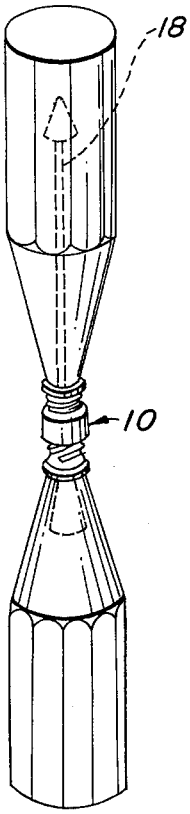
FIG. 1 is a perspective view showing the connector of this application as applied to a pair of ketchup bottles.

As shown in the drawings, the improved connector comprises a generally cylindrical tubular body 10 which is conically tapered on the outer diameter in mutually concentric relation at both ends 12 and 14 of the body for a length sufficient for stopper-like insertion and installation in the pour openings (not shown) of closed upper and lower containers of flowable material which are coupled together end-to-end in vertical relation, as shown in FIG. 1, for gravity transfer of the contents of one container to the other through the central passage of the tubular body 10. An enlarged cylindrical midsection 16 of the body 10, located about halfway between the tapered ends of the body, serves the dual purpose of support for an air vent tube 18 and purchase for the stopper-like hand installation of the body 10 in the pour openings of the containers.

Figure 2:
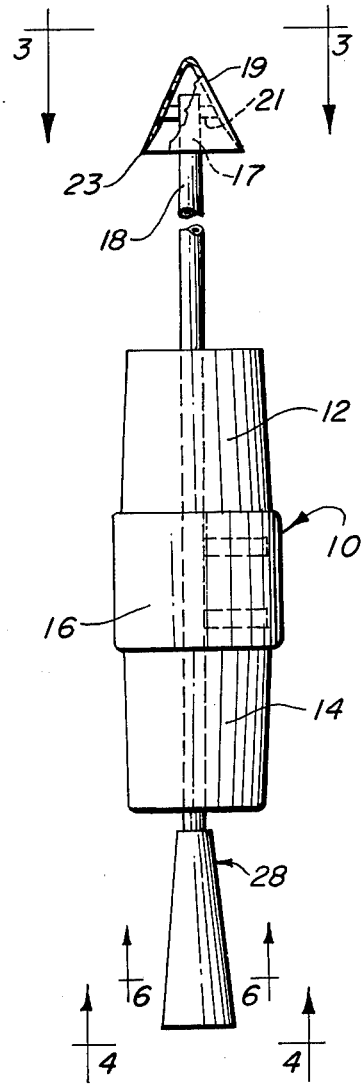
FIG. 2 shows an elevational view of the improved transfer connector.
Figure 3:
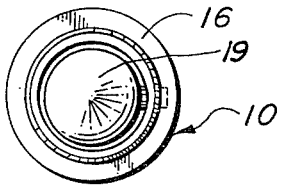
FIG. 3 shows a top view of the same as seen from the line 3—3 of FIG. 2.
Figure 5:
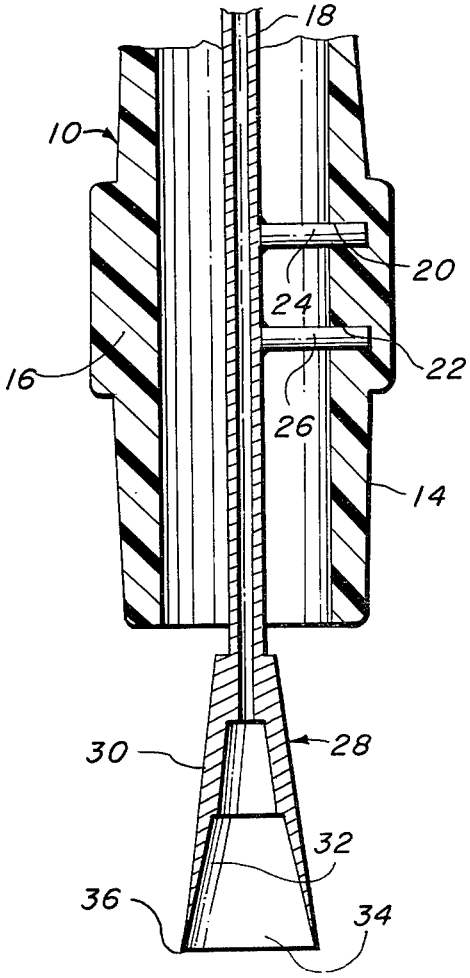
FIG. 5 shows a fragmented cross-sectional view as taken on line 5—5 of FIG. 4.
Figure 6:
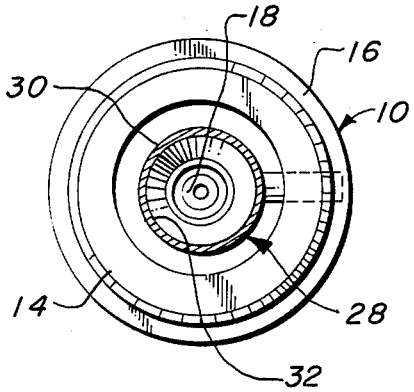
FIG. 6 shows a cross-sectional view as taken along line 6—6 of FIG. 2.

The air vent tube 18, as shown in FIGS. 2 and 5, is of small diameter in relation to that of the passage through the body 10 and is mounted within the body 10 so as to extend along the axis thereof. Sockets 20 and 22 (FIG. 5) are formed to extend radially into the enlarged body portion 16, from the inside of the body 10, in axially spaced and mutually co-planar relation one to the other and radial pin members 24 and 26, integral on the vent tube 18, install with a press-fit in the sockets 20 and 22 to secure the vent tube in place.

The inside diameter of the body 10 and the length of the pins 24 and 26 are such that the tube 18 can be received lengthwide in the body 10 and then displaced in a sidewise direction with the pins 24 and 26 aligned with the sockets 20 and 22 to mount the tube 18 in the body 10.

The length of the upper portion of the vent tube 18 is preferably such that its top end extends beyond the middle of the upper container, as shown in FIG. 1, when the connector is mounted in the pour opening of that container and the upper end 17 of the vent tube 18 is enclosed within an inverted cup-like cap 19 which is mounted on the vent tube by means of welded diametrical fins 21 so that the end opening of the tube 18 is in free communication with the interior of the upper container through the cap 19. The size of the cap at its open end is preferably only slightly smaller in diameter than the bore of the connector 10, so as to be passed through during assembly, and the wall of the cap terminates in a sharp knife-edge 23. This umbrella-like cap for the tube end 17 obviates clogging of the bore of the tube 18 when the connector is applied to the pour opening of the inverted upper container and the upper end of the tube 18 passes through the contents of the container. Also, the sharp edge 23 of the cap opening prevents gathering of material at that point.

Figure 4:
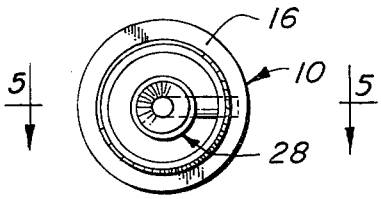
FIG. 4 shows a bottom view of the same as seen from line 4—4 of FIG. 2.

As shown in FIGS. 2, 4 and 5, the flared end of the connector tube 18 extends a relatively short distance beyond the end 14 of the body 10, which is to be fitted into the pour opening of the lower container, and comprises a deflector means 28 which provides a relatively wide and sharp-edge opening into the vent tube 18 for passage of air from the lower container to the upper container while the material in the upper container is flowing through the connector 10 for gravity transfer to the lower container. As shown, this lower end 28 of the vent tube is outwardly flared as at 30 and is counterbored as at 32 for form a wide end opening 34 leading into the vent tube 18 that is almost the same diameter as the passage through the connector body 10, the counterbore 32 having a greater rate of taper than the flare 30 so as to form a sharp knife-like edge 36 defining the opening 34. This sharp-edged and wide opening into the vent tube 18 is an important and critical feature of my improved material transfer connector for effecting transfer of the viscous contents from one partly-filled container to another and at the same time maintaining a free passage of air into the uppermost container and avoiding the formation of a vacuum therein sufficient to prevent free outward flow of its contents. The sharp edge 36 of the wide opening 34 prevents the adherence on the edge 36 of viscous material flowing along the outside of the flared end 28 of the vent tube and obviates any bridging and clogging of the said opening 34 which would prevent entry of air into the vent tube 18.

When the improved bottle coupler is to be used for transfer of material from one partly filled bottle to another, the bottle with the least amount of contents is selected to be the upper one of the bottle-coupler assembly. The coupler is then applied to the lower-to-be bottle by inserting the widened-end vent tube into the pour opening of the bottle and securely seating the adjacent end 14 of the coupler body in the pour opening, as one would do with a cork, and the bottle is set on a flat surface in upright position. Then the bottle selected to be the upper one is opened, quickly inverted, and then placed over the upstanding portion of the vent tube 18 and firmly seated on the upper body portion 12 of the coupler to complete the assembly.

When the upper bottle is invented and quickly applied over the shrouded vent tube to seat on the coupler, the tube cap 19 passes through the slowly downward moving bottle contents and into the open space above the said contents where air displaced from the bottom bottle can be freely received through the vent tube.

The cap or shroud 19 keeps the opening of the upper end 17 of the vent tube from becoming clogged as it passes through the upper bottle contents and the sharp edge 23 of the cap prevents the viscous contents of the bottle from gathering and possibly blocking the free passage of air from under the cap. Similarly the sharp edge 36 of the widened end opening 34 of the vent tube end portion 28 prevents the gathering of the viscous material at the opening 34 which might block the free entry of air from the bottom bottle.

It will be understood that the connector body 10 may be molded from any suitable plastic material that will satisfy the requirements for handling materials for human consumption. Likewise the vent tube 18, which is preferably made of metal, can be made of a suitable plastic material. Preferably the metal vent tube 18 would be incorporated with the body 10 during the molding operation by which the body 10 is formed.

Although but one specific embodiment of this invention is herein shown and described, it will be understood that details of the construction shown may be altered or omitted without departing from the spirit of the invention as defined by the following claims.

I claim:

1. In a viscous liquid transfer connector for gravity transfer of such material from one closed container having an outlet opening to another container having an inlet opening, said connector comprising a generally tubular body having upper and lower end portions formed for stopper-like insertion in the outlet opening of said one container and the inlet opening of the other container, respectively, and an air vent tube having upper and lower end openings mounted within said body to extend axially therethrough and beyond each end therefo, the improvement in the vent tube comprising a downwardly and outwardly flared deflector means extending from the lower end of the vent tube for widening the opening into the same and thereby preventing material flowing through said body and around said vent tube from gathering about and clogging the lower end opening of said tube and preventing the free flow of air thereinto from said other container, and an inverted cup-like cap mounted on the upper end of said vent tube and having a downward and outward divergence relative to the axis of the tube to position the end opening of the cap below the upper end opening of the tube.

2. A gravity transfer device as defined by claim 1 wherein the downwardly opening end of the cap is defined by a sharpened edge.

3. A connector for the gravity transfer of a flowable material from one closed container to another wherein each container has a pour opening, the said connector comprising a generally cylindrical tubular body having its opposite ends tapered and of a size for stopper-like insertion in the respective pour openings of said containers, said connector being adapted to hold the containers in end-to-end relation one above the other and including an air vent tube mounted in and extending axially through the said body, the said vent tube being open at each end and extending beyond one end of said body a distance sufficient to reach at least the center of the upper one of said containers, the opposite end of the vent tube extending beyond the other end of said body and terminating in a downwardly-extending and outwardly-flared deflector means, the free end of which is counterbored with an inwardly-converging taper to provide a sharp edge defining the end opening of the said tube, and the end of the vent tube which extends beyond said one end of the body being enclosed within an inverted cup-like cap secured to said tube, said cap opening toward said one end of the body with its sidewall diverging relative to the tube and terminating in a circumferential sharp edge, said vent tube opening into said cap above the open end thereof.

* * * * *